United States Patent [19]

Sakaki et al.

[11] Patent Number: 4,877,680

[45] Date of Patent: Oct. 31, 1989

[54] RECORDING MEDIUM WITH NON-POROUS INK-RECEIVING LAYER

[75] Inventors: Mamoru Sakaki, Hiratsuka; Ryuichi Arai, Sagamihara; Takashi Akiya, Yokohama; Shigeo Toganoh; Masahiko Higuma, both of Tokyo; Naonobu Eto, Yamato; Hidemasa Mouri; Michiaki Tobita, both of Yokohama; Masahiko Ishida, Fujisawa; Shunzo Kono, Yokosuka, all of Japan

[73] Assignee: Canon Kabushiki Kaisha, Tokyo, Japan

[21] Appl. No.: 246,948

[22] Filed: Sep. 20, 1988

Related U.S. Application Data

[63] Continuation of Ser. No. 932,524, Nov. 20, 1986, abandoned.

[30] Foreign Application Priority Data

Nov. 26, 1985 [JP] Japan ..... 60-263830

[51] Int. Cl.[4] ..... B41M 5/00

[52] U.S. Cl. ..... 428/332; 346/135.1; 428/195; 428/334; 428/335; 428/336; 428/409; 428/411.1; 428/500; 428/537.5

[58] Field of Search ..... 346/1.1, 135.1; 428/195, 211, 537.5, 332, 334, 336, 409, 411.1, 500

[56] References Cited

U.S. PATENT DOCUMENTS

| | | | |
|---|---|---|---|
| 4,554,181 | 11/1985 | Cousin et al. | 428/537.5 |
| 4,576,867 | 3/1986 | Miyamoto | 428/411.1 |
| 4,613,525 | 9/1986 | Miyamoto et al. | 428/195 |
| 4,636,805 | 1/1987 | Toganoh et al. | 428/210 |

FOREIGN PATENT DOCUMENTS

| | | | |
|---|---|---|---|
| 0199874 | 11/1986 | United Kingdom | 428/195 |

*Primary Examiner*—Ellis P. Robinson
*Assistant Examiner*—P. R. Schwartz
*Attorney, Agent, or Firm*—Fitzpatrick, Cella, Harper & Scinto

[57] ABSTRACT

A recording medium comprising a substrate and a non-porous ink receiving layer is provided. The ink receiving layer contains a water-insoluble polymer containing a cationic resin. The recording medium may be employed for recording by attaching droplets of a recording liquid thereon.

10 Claims, No Drawings

RECORDING MEDIUM WITH NON-POROUS INK-RECEIVING LAYER

This application is a continuation of application Ser. No. 932,524 filed Nov. 20, 1986, now abandoned.

BACKGROUND OF THE INVENTION

1. Field of the Invention

This invention relates to a recording medium to be used preferably for ink jet recording and a recording method by use thereof, particularly to a recording medium excellent in ink receptivity, sharpness, storability, water resistance, and surface gloss of the recorded image, etc., and a recording method by use thereof.

2. Related Background Art

Ink jet recording performs recording by generating small droplets of ink by employing various ink (recording liquid) ejecting systems, such as an electrostatic attraction system, the system of giving mechanical vibration or displacement to ink by use of a piezoelectric element, the system in which the pressure formed when ink is bubbled by heating is utilized, then permitting them to fly and attaching a part or whole thereof onto a recording medium such as paper. This method is now attracting attention as a recording method which generates less noise and is capable of performing high-speed printing and multi-color printing.

As inks for ink jet recording, there have been used those composed mainly of water and a hydrophilic solvent, primarily for the reasons of safety and recording characteristics, and in most cases, a polyhydric alcohol is added for prevention of clogging of nozzles and improvement of ejection stability.

As the recording medium to be used for the ink jet recording method, there have been employed recording media comprising a porous ink-receiving layer provided on a conventional paper or a substrate known as the ink jet recording paper.

However, a ink jet recording is improved in performance such as speed or multi-coloration, and is popularized, the recording medium also is required to have a higher level of characteristics.

More specifically, it is required that ink should be absorbed as rapidly as possible, and that the spread of ink droplets should be adequate.

Further, for carrying out color jet recording by use of color inks, a recording medium is required which is particularly excellent in color forming property and sharpness and can give high coloration.

Further, the recorded image by ink jet recording is required to be excellent in storability, durability and water resistance.

While the recorded images obtained by the ink jet recording method have been employed exclusively for surface image observation, recording media suited for uses other than for surface image observation are being demanded because of the improvement in performances or the wide popularization of ink jet recording.

Uses of the recording medium other than for surface image observation may include those in which recorded images are projected onto a screen, etc. by means of an optical instrument such as a slide or an OHP (an overhead projector), etc.; color resolution plates for preparation of a positive plate for color printing; CMF (a color mosaic filter), etc. to be used for color display such as liquid crystal, etc.

When the recording medium is to be used for surface image observation, the diffused light of the recorded image is observed, while the transmitted light through the recorded images becomes a problem in the recording medium in the uses other than surface observation. Accordingly, light transmissivity, particularly excellent linear transmittance is required in addition to the general requisite performances of the recording medium for ink jet recording.

However, prior to the present invention, no recording medium satisfying all these requisite performances has yet been known.

Also, most of the recording media for observation of the surface image of the prior art have used a system in which a porous ink-receiving layer is provided on the surface to fix the recording agent by receiving ink in the porous void, and therefore, the surface of the recording medium has no gloss based on the fact that it is porous.

On the other hand, when the surface of the ink receiving layer is non-porous, volatile components such as polyhydric alcohol, etc., in the ink will remain on the surface of the recording medium after recording. Thus it will take a long time for drying and fixing of the ink, whereby there are involved the drawbacks such that clothing may be soiled by contact with a recorded image or that the recorded image may be damaged.

However, as described above, there is a strong demand for a recording medium having light transmissivity and a recording medium having gloss on the surface. In the case of recording media of such embodiments, it is essential that the surface of the recording medium be non-porous. For such demands, in order to enhance affinity for ink and ink receptivity, it has been the practice in the prior art to use a recording medium comprising a non-porous ink-receiving layer formed by use of a water-soluble polymer.

For example, U.S. Pat. No. 4,503,111 (Tektronics) purposes a recording medium having a non-porous ink-receiving layer formed by using primarily a polyvinylpyrrolidone.

However, such a recording medium has the problems such that the recorded image is low in light fastness, or that due to strong stickiness of the surface of the ink receiving layer after receiving the ink, blocking is liable to occur when the printed media are placed one upon another, or when a paper, etc., is superposed on the recorded surface. Thus, even in such a recording medium, when the recording medium is placed under high humidity, attachment of water droplets, etc., on the surface of the recording medium will cause the surface of the ink receiving layer to have stickiness, whereby troubles may be caused such as mutual blocking between recording media or sticking of the recording medium to the conveying system of a printer, etc. In the recording medium after recording, there is also the problem that the recorded image may be damaged by migration or flowing-out, etc., of the dye at the printed portion.

SUMMARY OF THE INVENTION

An object of the present invention is to provide a recording medium for ink jet recording which is particularly excellent in ink receptivity, and sharpness and surface gloss of the recorded images, particularly suitable for obtaining a highly precise image and a recording method by use thereof.

Another object of the present invention is to provide a recording medium for full clock ink jet recording which is excellent in water resistance, free from stickiness or blocking on the surface even under highly humid conditions, and also free from migration or flowing-out of the dye when water droplets may be attached on the surface of the recorded image, or even when left to stand under highly humid conditions, and a recording method by use thereof.

Still another object of the present invention is to provide a recording medium for use in ink jet recording, which can be used for observation by projection of recording images onto a screen, etc., by an optical instrument such as slide, OHP, etc., or for observation of transmitted light such as color resolution plate in preparation of a positive plate for color printing or CMF, etc., to be used for color display such as liquid crystal, etc., and a recording method by use thereof.

The above objects and other objects of the present invention can be accomplished by the present invention as defined below.

According to an aspect of the present invention, there is provided a recording medium comprising a substrate and a non-porous ink receiving layer provided thereon, said ink receiving layer containing a water-insoluble polymer containing a cationic resin.

According to another aspect of the present invention, there is provided a recording medium comprising a substrate and a non-porous ink receiving layer provided thereon, said ink receiving layer comprising as a main constituent a water-insoluble polymer containing 2 to 30% by weight of a cationic resin based on the water-insoluble polymer.

According to further aspect of the present invention, there is provided a recording medium performing recording by attaching droplets of a recording liquid on a recording medium, said recording liquid containing a water-soluble dye, water and an organic solvent, said recording medium comprising a non-porous ink receiving layer provided on a substrate, and the ink receiving layer comprising a water-insoluble polymer containing a cationic resin.

DETAILED DESCRIPTION OF THE PREFERRED EMBODIMENTS

The recording medium of the present invention is characterized primarily by its ink receiving layer which comprises a water-insoluble polymer and contains a cationic resin therein, and the objects of the present invention are accomplished primarily by this feature.

The recording medium of the present invention generally comprises a substrate as a supporting member and a recording face provided on its surface, namely an ink receiving layer, including, for example, the particularly preferable embodiments as follows:

(1) The embodiment in which both the substrate and the ink receiving layer are light-transmissive, and the recording medium as a whole is light-transmissive;

(2) The embodiment in which the surface of the ink receiving layer is smooth and has gloss.

In each embodiment, the ink receiving layer may also function as the supporting member simultaneously.

The present invention is described in more detail by referring to some preferable embodiments as mentioned above as typical examples.

More specifically, according to the detailed study by the present inventors, it has been found that a recording medium satisfying the various requirements as mentioned above, particularly water resistance and anti-blocking property, etc., under highly humid conditions can be obtained first by forming its ink receiving layer of water-insoluble polymer. Although the ink receiving layer comprising such a water-insoluble polymer can sufficiently solve various problems under highly humid conditions such as water resistance, stickiness, blocking, etc., ink receptivity, fixing characteristic for aqueous ink, water resistance of the printed portion, etc., cannot necessarily be satisfied. However a specific amount of a cationic resin included in the ink receiving layer can solve the problems of ink receptivity, fixing characteristic, color forming property of dye, water resistance of printed portion, sharpness, preciseness of recorded images, etc., while retaining the various excellent performances obtained by a water-insoluble polymer.

The water-insoluble polymer which characterizes the present invention is not a general hydrophobic polymer having no hydrophilic property at all, but it is a polymer which is insoluble in water but is sufficiently hydrophilic. Specific examples of such hydrophilic and water-insoluble polymers are shown below.

(1) Block copolymer or graft copolymer having hydrophilic segments and hydrophobic segments in the molecule:

Such a block copolymer or graft copolymer is water-insoluble as a whole, but hydrophilic. The hydrophilic segment of such a polymer is a segment of a polymer of two or more vinyl monomers having hydrophilic groups such as carboxylic group, sulfonic acid group, hydroxyl group, ether group, acid amide group, methylolated groups thereof, primary to tertiary amino groups, quaternary ammonium group, etc., and examples of such hydrophilic monomer may include (meth)acrylic acid, maleic anhydride, vinylsulfonic acid, sulfonated styrene, vinyl acetate, mono(meth)acrylate or monomaleate of a polyol such as ethylene glycol, (meth)acrylic acid amide, methylolated products thereof, mono- or di-alkylaminoethyl (meth)acrylate, quaternarized products thereof, vinyl pyrrolidone, vinyl pyridine, etc.

The hydrophobic polymer segment is a polymer of two or more monomers, including olefins such as ethylene, propylene, butylene, etc.; aromatic vinyl compound such as styrene, methyl styrene, vinyl naphthalene, etc.; halogenated olefins such as vinyl chloride, vinylidene chloride, vinylidene fluoride, etc.; various alcohol esters of unsaturated carboxylic acids such as (meth)acrylic acid, crotonic acid and others; etc.

Also, other water-soluble polymers than those mentioned above, namely hydrophilic natural or synthetic polymers, including, for example, natural resins such as albumin, gelatin, casein, starch, cationic starch, gum arabic, sodium alginate, etc., polyvinyl alcohol, polyamide, polyacrylamide, polyvinyl pyrrolidone, polyethyleneimine, polyvinylpyridinium halide, melamine resin, polyurethane, polyester, sodium polyacrylate, etc., or hydrophobic natural or synthetic polymers obtained by modifying these to water-insoluble can be used as the hydrophilic polymer segments or hydrophobic polymer segments as a matter of course.

(2) Crosslinked product of water-soluble polymer:

This is obtained by crosslinking various water-soluble polymers, etc., as mentioned above and described below with an appropriate crosslinking agent or radiation to the extent that they can become water-insoluble without losing hydrophilic property.

(3) Polymer complex comprising acidic polymer and basic polymer:

Such a polymer complex comprises a basic polymer and an acidic polymer, and is known per se as disclosed in Japanese Patent Publications Nos. 37017/1976 and 42744/1980.

Preferable basic polymers for formation of such a polymer complex are inclusive of those shown below.

Homopolymers of N-vinylpyrrolidone, N-vinyl-3-methylolpyrrolidone, N-vinyl-5-methylpyrrolidone, N-vinyl-3,3,5-trimethylpyrrolidone, N-vinyl-3-benzylpyrrolidone, N-vinylpiperidone, N-vinyl-4-methylpiperidone, N-vinyl-caprolactam, N-vinylcapryl-lactam, N-vinyl-3-morpholine, N-vinylthiopyrrolidone, N-vinyl-2-pyrrolidone and the like, or random copolymers, block copolymers, graft copolymers thereof with other monomers in general;

homopolymers of N-vinyl-2-oxazolidone, N-vinyl-5-methyl-2-oxazolidone, N-vinyl-5-ethyl-2-oxazolidone, N-vinyl-4-methyl-2-oxazolidone, N-vinyl-2-thiooxazolidone, N-vinyl-2-mercaptobenzothiazole and the like, or random copolymers, block copolymers, graft copolymers thereof with other monomers in general;

homopolymers of N-vinylimidazole, N-vinyl-2-methylimidazole, N-vinyl-4-methylimidazole and the like, or random copolymers, block copolymers, graft copolymers thereof with other monomers in general;

homopolymers of 2- or 4-vinylpyridine, etc., or random copolymers, block copolymers, graft copolymers thereof with other monomers in general; and so on. Other copolymerizable monomers which may be used in the above copolymers may include monomers in general such as methacrylate, acrylate, acrylamide, acrylonitrile, vinyl ether, vinyl acetate, vinyl imidazole, ethylene, styrene and others.

Particularly useful are homopolymers and copolymers of N-vinylpyrrolidone, N-vinylpiperidone, N-vinylcaprolactam, N-vinylmorpholine, N-vinyl-2-oxazolidone and N-vinyl-5-methyl-2-oxazolidone. In the case of copolymers, it is preferred that the nitrogen containing monomer as mentioned above should be contained at a proportion of 50 mol% or more.

On the other hand, the acidic polymer capable of forming a polymer complex with the above basic polymer (here, the "acidic polymer" in the present invention is inclusive of those having alcoholic hydroxyl group in the molecule, in addition to those having sulfonic acid group, carboxylic acid group, sulfate ester group, phosphate ester group, phenolic hydroxyl group) may include those shown below.

1. Polymer having carboxylic acid group

Terminal carboxylic group polyesters obtained by the reaction of polycarboxylic acids such as citric acid, tartaric acid, phthalic acid, etc., and polyhydric alcohols such as ethylene glycol, 1,4-butanediol, diethylene glycol, etc., in acid excess;

acidic cellulose derivatives modified with various polycarboxylic acids (see Japanese Patent Publication No. 5093/1960);

homopolymers of polycarboxylic acid vinyl ether ester monomers, etc., or random copolymers, block copolymers, graft copolymers thereof with other monomers in general (see Japanese Patent Publication No. 8495/1960);

homopolymers of monomers such as acrylic acid or methacrylic acid, random copolymers, block copolymers, graft copolymers thereof with other monomers in general;

homopolymers of $\alpha,\beta$-unsaturated vinyl monomers such as maleic anhydride, itaconic acid, etc., random copolymers, block copolymers, graft copolymers thereof with other monomers in general (see Murahashi, Inoue, Tani ed., "Gosei Kobunshi (Synthetic Polymer) (III)", P. 250–257 and P. 374–380, Asakura Shoten, 1971).

2. Polymer having sulfonic acid group:

Cellulose derivatives such as O-ethyl cellulose acetate hydrogen sulfate hydrogen phthalate, cellulose acetate hydrogen sulfate hydrogen phthalate, ethyl cellulose hydrogen-O-sulfobenzoate, O-P-sulfobenzyl cellulose acetate, O-ethyl-O-P-sulfoethyl cellulose acetate, etc. (see Japanese Patent Publication No. 5093/1960);

sulfonic acid modified polymers of polyvinyl alcohol or vinyl alcohol copolymers with sulfonic acid compounds (e.g. O-sulfobenzoic acid, sulfopropionic acid, sulfovaleric acid, sulfobenzoaldehyde, sulfophthalic acid, etc.).

3. Polymer having hydroxyl group:

Ethyl cellulose, benzyl cellulose, hydroxyethyl cellulose, hydroxyethyl/ethyl cellulose, hydroxyethyl/benzyl cellulose and the like;

homopolymers of monomers having sulfonic acid or phenol groups, or random copolymers, block copolymers and graft copolymers thereof with other monomers in general;

otherwise acid modified products of various polymers with compounds containing carboxylic groups or sulfonic acid groups or phenolic groups.

Preferable basic polymers and acidic polymers for forming the polymer complex as described above should have molecular weights of 500 or more, preferably 1000 or more, respectively, and by use of the both polymers with these molecular weights, an ink receiving layer excellent in ink respectivity, sharpness of image, water resistance can be formed.

The proportions of the polymers used may be within the range of from 20/1 to 1/10 in terms of the weight ratio of the basic polymer/acidic polymer.

The second specific feature of the recording medium of the present invention resides in that a specific amount of a cationic resin is included during formation of the ink receiving layer from the hydrophilic and water-insoluble polymer as described above.

As such a cationic resin, any of the polymers known in the art having an ionic cationic group can be used in the present invention, preferably having quaternary ammonium groups, particularly preferably the compounds represented by the formula (I) shown beloqw and polydiallylamine derivatives or acrylamides, etc., having the monomers represented by the formulae (II)–(IV) shown below.

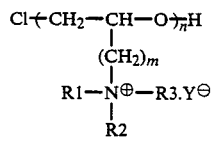

(I)

wherein R1, R2, R3 each represent hydrogen or an alkyl group, m is 1 to 7, n is 2 to 20, and Y represents an acid group.

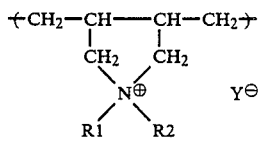

(II)

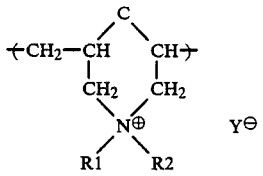

(III)

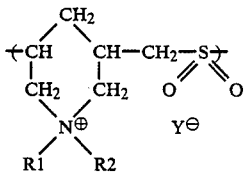

(IV)

In the formulae (II)-(IV), R1 and R2 each represent $-CH_3$, $-CH_2-CH_3$, $-CH_2CH_2OH$, Y represents an acid group.

Examples of the compound represented by the formula (I) may include Narpoly-607 (produced by Narcochemical Co.), Polyfix 601 (produced by Showa Highpolymer Co., Ltd.), etc.

The compounds represented by the formulae (II)--(IV) are polydiallylamine derivatives, which can be obtained by cyclic polymerization of diallylamine compounds, and may be exemplified by Percol 1697 (produced by Allied Colloid Co.), Cat Floc C (produced by Calgon Corp), PAS (produced by Nitto Boseki Co., Ltd.), Neofix RPD (produced by Nikka Kagaku Co., Ltd.).

The ink receiving layer of the recording medium of the present invention is preferably formed in a non-porous state from the hydrophilic and water-insoluble polymer and the cationic resin as described above, and the cationic resin added is controlled to within the range of from 2 to 30 wt.%, preferably 3 to 20 wt.% based on the water-insoluble polymer. For formation of a non-porous ink-receiving layer, during formation of the ink receiving layer, without use of an excessive amount of fillers, etc., a solution of the materials as described above may be applied and dried on the substrate to form the layer.

In the prior art, for example, in Japanese Laid-open Patent Publication Nos. 84992/1981 and 20696/1984, etc., recording media containing cationic resins such as polyvinylpyridinium bromide, dimethylammonium chloride, etc., in a porous ink-receiving layer have been known. In the case of such a recording medium having a porous surface, since the cationic resin contained in the ink receiving layer is adsorbed by the porous pigment or cellulose fiber elements at the outermost portion of the ink receiving layer, the preferable amount added was about 0.01 to 2 wt.% of the coated layer in the case of a coated paper.

In the case of a recording medium having an ink receiving layer with porous surface, since the dye in the ink is captured by the porous layer near the surface of the recording medium and also similarly forms some kind of bonding with the cationic resin existing on the outermost surface, the amount of the cationic resin may be sufficiently about 0.01 to 0.1 wt.%. If the amount is increased to more than that range, for example, 2-3 wt.% or more, there may be caused problems such as decoloration or sticking of the recording medium surface due to lowering in ink absorbing capacity of the ink receiving layer or a bleed of the cationic resin.

However, in the case when the ink receiving layer contains a cationic resin in the recording medium with a non-porous surface as in the recording medium of the present invention, the ink absorbing mechanism is different from that of the porous ink receiving layer (in the case of a non-porous ink receiving layer, according to swelling of the ink receiving layer), and therefore effect of the cationic resin added is different.

In the case of a recording medium with a non-porous surface, the dye received at the surface reaches the innermost portion of the ink receiving layer, and the cationic resin is uniformly dispersed in the resin forming primarily the ink receiving layer. For sufficient water resistance of the printed portion, 2 wt.% or more of a cationic resin is required, and neither lowering in ink absorbency nor bleed or cationic resin as in the case of porous ink-receiving layer will occur even if 2 wt.% or more of a cationic resin is contained. However, in the case of a non-porous surface, if a cationic resin is contained in excess of 30 wt.%, the film forming property of the ink receiving layer will be deteriorated or lowered and otherwise the water resistance of the ink receiving layer itself will be undesirably lowered, whereby the surface of the ink receiving layer becomes sticky due to the cationic resin under highly humid conditions.

Thus, the present inventors have found that the preferable content of a cationic resin when added in a recording medium with a non-porous surface is about 2 to 30 wt.%, preferably 3 to 20 wt.%, which is not suitable in the porous case, and therefore it is one of the specific features of the present invention to contain a cationic resin at a proportion as specified above.

In the present invention, in addition to the water-insoluble polymer and the cationic resin as described above, other water-soluble to hydrophilic polymers may be employed in combination within the range which does not impair the objects of the present invention.

Further, for strengthening the ink receiving layer and/or adhesion to the substrate, if desired, hydrophobic resins such as SBR latex, NBR latex, polyvinylformal, polymethyl methacrylate, polyvinyl butyral, polyacrylonitrile, polyvinyl chloride, polyvinyl acetate, phenol resin, alkyd resin, etc., may be used in combination within the range which does not impair the objects of the present invention.

Also, for improvement of ink absorbency of the ink receiving layer, it is possible to disperse fillers such as silica, clay, talc, diatomaceous earth, calcium carbonate, calcium sulfate, barium sulfate, aluminum silicate, synthetic zeolite, alumina, zinc oxide, lithopon, satin white, etc. in the ink receiving layer, within the range which does not make the ink receiving layer porous.

As for the substrate to be used as the supporting material for the ink receiving layer in the present invention, it may be any transparent or opaque substrate known in the art. Preferable examples of transparent substrates may include films or plates such as of polyester resins, diacetate resins, polycarbonate resins, polyvinyl chloride resins, polyimide resins, cellophane, celluloid, etc. and glass plates. Preferable opaque substrates may include, for example, paper, cloth, wood, metal plate, synthetic paper in general, or otherwise the above transparent substrates which have been subjected to opacifying treatment according to known means.

The recording medium of the present invention is formed by use of the principal materials as described above, and in the preferable embodiment of the above (1), both the substrate and the ink receiving layer are light transmissive with linear transmittance being 10% or higher, and the recording medium as a whole is light-transmissive.

The recording medium according to this embodiment is particularly excellent in light-transmissivity and therefore is used primarily in the case of OHP, etc., for projecting recorded images by an optical instrument onto a screen, etc., and it is useful as the recording medium for observation of transmitted light.

Such a light-transmissive recording medium can be prepared by forming a light-transmissive ink receiving layer from a mixture of the water-insoluble polymer and the cationic resin as described above on the light-transmissive substrate as described above.

As the method for forming such an ink receiving layer, there may preferably be employed a method in which a coating solution is prepared by dissolving or dispersing a mixture of the water-insoluble polymer and the cationic resin as described above and said coating solution is coated on the light transmissive substrate according to known methods such as roll coating, rod bar coating, spray coating, air knife coating, etc., followed by rapid drying, or a method in which a solution of the water-insoluble polymer is applied and then a solution of the cationic resin is applied. It is also possible to use the method in which a mixture of the above water-insoluble polymer and the cationic resin is subjected to hot melt coating or the method in which a single film for ink receiving layer is once formed from the materials as described above, and said film is laminated on the above substance.

The recording medium of the present invention according to the embodiment (1) formed as described above is a light-transmissive recording medium having sufficient light transmissivity.

The sufficient light transmissivity as herein mentioned means that the linear transmittance of the recording medium should desirably exhibit at least 2%, preferably at least 10%.

If the linear transmittance is 2% or higher, the recorded image can be observed by projection by OHP, for example, onto a screen. Further, in order for the fine portion of the recorded image to be observed sharply, the linear transmittance should desirably be 10% or higher.

The linear transmittance T (%) as herein mentioned is a value which is determined by measuring the spectral transmittance of the linear light which enters a sample perpendicularly, transmits through the sample, passes through a slit on the light receiving side which is located at least 8 cm apart from the sample on the line extended from the incident light pathway and is received on a detector, for example, by means of 323 Model Hitachi Automatic Recording Spectrophotometer (produced by Hitachi Seisakusho), further determining the Y value of tristimulus values of color and calculating from the following formula:

$$T = Y/Yo \times 100 \quad (1)$$

T: linear transmittance
Y: Y value of a sample
Yo: Y value of a blank

Thus, the linear transmittance as mentioned in the present invention is relative to linear light, and it is different from diffuse transmittance (determined so as to be inclusive of diffused light by providing an integrating sphere at the rear of a sample) or opacity (determined from the ratio of values when white and black backings are applied on the back of a sample) according to the method in which ligh transmissivity is evaluated with diffused light.

Since a problem in an instrument utilizing optical techniques is the behavior of linear light, it is particularly important to determine the linear transmittance of a recording medium in evaluation of the light transmissivity of the recording medium to be used in such an instrument.

For example, in the case of observing a projected image by OHP, in order to obtain an image which is high in contrast between the recorded portion and the non-recorded portion and which is sharp and easy to observe, it is demanded that the non-recorded portion in the projected image should be light, namely that the linear transmittance of the recording medium should be at a certain level or higher. In the test by use of a test chart in OHP, for obtaining an image suited for the above purpose, the linear transmittance of the recording medium is required to be 2% or higher, preferably 10% or higher in order to obtain a sharper image. Therefore, the recording medium suited for this purpose is required to have a linear transmittance which is at least 10%.

The preferable embodiment of the above (2) is also a kind of the above embodiment (1) and is characterized in that its ink receiving layer has a smooth surface, with the 45° specular gloss based on the JIS Z 8741 being 30% or higher.

The recording medium of this type is particularly excellent in surface gloss, and particularly useful as the recording medium for observation of surface images of full color excellent in sharpness.

The recording medium in this embodiment may be either transparent or opaque, and any of the transparent and opaque substrates as described above can be used. Also, the ink receiving layer formed on these substrates may be either transparent or opaque. The materials and the methods, etc., to be used for formation of the ink receiving layer may be the same as in the above embodiment (1), but the fillers, etc., as mentioned above may be used to the extent that the ink receiving layer becomes opaque, so long as the smoothness of the surface of ink receiving layer can be maintained.

If necessary, in addition to the coating methods as mentioned above, the cast coating method may be employed, or gloss may be imparted by means of calender rolls.

In the present invention as described above, the ink receiving layer to be formed on the substrate may have a thickness, which is generally 1 to 200 μm, preferably 3 to 100 μm, more preferably 5 to 30 μm.

Further, in the present invention, by imparting organic or inorganic fine powder in an amount of about 0.01 to about 1.0 g/m$^2$ on the recording surface of the light-transmissive recording medium of various embodiments as described above, the conveying characteristic within the printer, antiblocking characteristic during piling, fingerprint resistance, etc. of the recording medium obtained can be further improved.

Having described above by referring to examples of typical embodiments of the light-transmissive recording medium of the present invention, the light-transmissive recording medium of the present invention will not of course be limited to these embodiments. In either of these embodiments, it can further incorporate various known additives, including dispersing agents, fluorescent dyes, pH controllers, defoaming agents, lubricants, preservatives, surfactants etc.

The recording medium of the present invention is not necessarily required to be colorless, but it may also be a colored recording medium.

The recording medium of the present invention as described above is a recording medium having an ink receiving layer with non-porous surface and can exhibit excellent ink receptivity and provide a recorded image of excellent gloss, water resistance and sharpness at the printed portion, and yet with its surface not becoming tacky or sticky.

Thus, to say nothing about mono-color, even when inks with different colors in full-color image recording are attached on the same spot to overlap each other within a short time, there is no phenomenon such as flow-out or ooze-out, whereby the ink receiving layer will not be lowered in strength and there can be obtained an image which is sharp with high resolution.

Moreover, the recording medium of the present invention, being different from the recording medium using a water-soluble polymer of the prior art, is excellent in water resistance and therefore, when left to stand under highly humid conditions, the surface of the ink receiving layer will not become sticky or tacky when water droplets, etc., adhere on the surface. Also, in the recording medium after recording, there occurs no migration or flowing-out of the dye at the recorded portion, whereby recorded images excellent in storability and water resistance can be given.

In the present invention, it is also possible to provide a recording medium which is excellent in water resistance and also in surface gloss which could not be seen in the recording medium for ink jet recording of the prior art. Also, the recording medium of the present invention is applicable for uses other than for observation of surface images of the prior art such as those used for observation of the recorded image projected onto a screen, etc., by an optical instrument such as slide or OHP, color resolution plates during preparation of positive plates for color printing or CMF used for color display such as liquid crystal, etc.

The present invention is described in more detail by referring to Examples, Comparative examples and Use examples. In the description, parts and % are based on weight.

EXAMPLE 1

88 parts of a 10% dimethylformamide (hereinafter called DMF) solution of a polyvinylpyrrolidone (PVPK-90, produced by GAF) and 12 parts of 10% DMF solution of a novolac type phenol resin (Resitop PSK-2320, produced by Gun-ei Chemical Industries Co., Ltd.) were mixed. The mixture was gelled to form a polymer complex, but when the mixture was heated with stirring to 90° C., it became a solution. To this solution were added 2 parts of 50% ethanol solution of a cationic resin (Elecond PQ-10, produced by Soken Chemical Co., Ltd.), and this was used as the coating solution.

As a light transmitting substrate, a polyethylene terephthalate film with a thickness of 100 μm (produced by Toray) was used, and the above coating solution was applied on this film according to the bar coater method to a film thickness after drying of 8 μm, followed by drying at 80° C. for 10 minutes, to obtain a light-transmitting recording medium of the present invention.

The recording medium of the present invention thus obtained was found to be colorless and transparent.

EXAMPLE 2

In the same manner as in Example 1 except for using a commercially available cast coated paper as the substrate, a recording medium of the present invention was obtained.

EXAMPLE 3 AND COMPARATIVE EXAMPLES 1–2

According to the compositions shown below, coating solutions were prepared in the same manner as in Example 1 and ink receiving layers were provided in the same manner as in Example 1 on the same polyethylene terephthalate film as used in Example 1 to obtain a light transmissive recording medium of the present invention and two recording media for comparative purpose.

Coating Solution Composition of Example 3

| | |
|---|---|
| Polyvinylpyrrolidone (PVPK-90, produced by GAF) <10% DMF solution> | 83 parts |
| Styrene/acrylic acid copolymer (Oxylac SH-2100, produced by Nippon Catalyst Chemical Industry Co., Ltd. <10% DMF solution> | 16 parts |
| Cationic resin (GAFQUAT 734, produced by GAF) <50% ethanol solution> | 1 part |

Coating Solution Composition of Comparative Example 1

| | |
|---|---|
| Polyvinylpyrrolidone (PVPK-90, produced by GAF) <10% aqueous solution> | 50 parts |
| Polyvinyl alcohol (PVA-217, produced by Kuraray) <10% aqueous solution> | 50 parts |

Coating Solution Composition of Comparative Example 2

The same coating solution composition as in Example 1 except that no cationic resin (Elecond PQ-10) was added into the coating solution.

EXAMPLE 4

| | |
|---|---|
| Comb type polymer (produced by Soken Chemical Co., Ltd.) <25% methylcellosolve solution> | 60 parts |
| Methylvinyl ether/maleic acid mono-n-butyl ester copolymer (GANTREZ ES-425, produced by GAF) <10% water/ethanol solution> | 38 parts |
| Cationic resin (Elecond PQ-10, produced by Soken Chemical Co., Ltd.) <50% ethanol solution> | 2 parts |

The above comb type polymer comprises 80 parts of a copolymer (main chain) comprising 64 parts of 2-hydroxyethyl methacrylate and 16 parts of dimethylacrylamide, to which 20 parts of MMA macromer were graft polymerized.

Coating Solution Composition of Example 5

| | |
|---|---|
| Polyvinylpyrrolidone (PVP K-90, produced by GAF) <10% DMF solution> | 100 parts |
| Isobutylene/maleic anhydride copolymer (ISOBAM, Kuraray Isoprene Chemical) <10% DMF solution> | 30 parts |
| Cationic resin (POLYFIX 601, produced by Showa Highpolymer Co., Ltd.) <10% DMF solution> | 25 parts |

Coating Solution Composition of Comparative Example 3

The same coating solution composition of Example 2 except that no cationic resin (POLYFIX 601) was added into the coating solution.

For the recording media of the above Examples and Comparative examples, by use of the four kinds of inks shown below, ink jet recording was practiced by use of an on-demand type ink jet printer (PJ 1080A, produced by Canon K.K.) which discharges inks by piezoelectric oscillators.

| | |
|---|---|
| Yellow ink (composition) | |
| C.I. Direct Yellow 86 | 2 parts |
| Diethylene glycol | 20 parts |
| Polyethylene glycol #200 | 10 parts |
| Water | 70 parts |
| Red ink (composition) | |
| C.I. Acid Red 35 | 2 parts |
| Diethylene glycol | 20 parts |
| Polyethylene glycol #200 | 10 parts |
| Water | 70 parts |
| Blue ink (composition) | |
| C.I. Direct Blue 86 | 2 parts |
| Diethylene glycol | 20 parts |
| Polyethylene glycol #200 | 10 parts |
| Water | 70 parts |
| Black ink (composition) | |
| C.I. Food Black 2 | 2 parts |
| Diethylene glycol | 20 parts |
| Polyethylene glycol #200 | 10 parts |
| Water | 70 parts |

Evaluation results of the recording media of the Examples and Comparative examples are shown in Table 1.

The respective evaluation items in Table 1 were measured according to the methods shown below.

(1) Ink fixing time was measured by leaving the recording medium after practice of recording to stand under room temperature (20° C., 65 %RH) and measuring the time before ink no longer attaches to a finger when the recorded image is touched with the finger.

(2) Dot density was measured for black dots by use of Sakura microdensitometer PDM-5 (produced by Konishiroku Photo Industry Co., Ltd.) by applying JIS K 7505 for printed microdots.

(3) Linear transmittance was determined from the above formula (1) by measuring spectral transmittance by use of 323 model Hitachi automatic recording spectrophotometer (produced by Hitachi Seisakusho Co., Ltd.) by maintaining the distance from the sample to the window on the light receiving side at about 9 cm.

(4) For gloss, 45° specular gloss was measured on the surface of recording medium based on JIS Z-8741.

(5) Water resistance was evaluated by comparison of the optical density (O.D.) after immersion measured by use of a Macbeth densitometer when the recording medium was immersed in stationary water for 5 minutes with the O.D. value before immersion. The sample unmeasurable on account of dissolution of the ink receiving layer during immersion was rated as x.

TABLE 1

| | Example | | | | | Comparative example | | |
|---|---|---|---|---|---|---|---|---|
| | 1 | 2 | 3 | 4 | 5 | 1 | 2 | 3 |
| Ink fixing time | 3 min. | 3 min. | 1 min. | 3 min. | 3 min. | 1 min. | 3 min. | 1 min. |
| Dot density | 1.1 | 1.0 | 1.1 | 1.1 | 1.1 | 1.1 | 1.1 | 1.1 |
| Linear transmittance | 79% | — | 79% | 78% | 77% | 80% | 79% | 79% |
| Gloss | — | 70% | — | — | — | — | — | — |
| Water resistance | 92% | 91% | 89% | 87% | 93% | x | 34% | 40% |

We claim:

1. A recording medium comprising a substrate and a non-porous ink receiving layer provided thereon, said ink receiving layer comprising a water-insoluble polymer complex and a cationic resin of 2 to 30% by weight based on said polymer complex, said polymer complex being formed from an acidic polymer and a basic polymer.

2. The recording medium according to claim 1, wherein the weight ratio of the basic polymer and the acidic polymer is within the range of 20/1 to 1/10.

3. The recording medium according to claim 1, wherein each of the basic polymer and the acidic polymer has a molecular weight of not less than 500.

4. The recording medium according to claim 1, wherein said recording medium has a linear transmittance of not less than 10%.

5. The recording medium according to claim 1, wherein the ink receiving surface of said recording medium has a 45° specular gloss of at least 30% according to JIS Z 8741.

6. The recording medium according to claim 1, wherein said cationic resin is a polydiallylamine derivative or an acrylamide.

7. The recording medium according to claim 1, wherein the ink receiving layer has a thickness in the range of from 1 to 200 μm.

8. The recording medium according to claim 1, wherein the ink receiving layer has a thickness in the range of from 3 to 100 μm.

9. The recording medium according to claim 1, wherein the ink receiving layer has a thickness in the range of from 5 to 30 μm.

10. The recording medium according to claim 1, wherein the cationic resin is contained in an amount of 3 to 20% by weight based on the water-insoluble polymer.

* * * * *

UNITED STATES PATENT AND TRADEMARK OFFICE

CERTIFICATE OF CORRECTION

PATENT NO. : 4,877,680

DATED : October 31, 1989

INVENTOR(S) : Mamoru Sakaki, et al.

It is certified that error appears in the above-identified patent and that said Letters Patent is hereby corrected as shown below:

COLUMN 1:

Line 40, "a" should read --as--.

COLUMN 2:

Line 38, "purposes" should read --proposes--.

Line 68, "clock" should read --color--.

COLUMN 3:

Line 11, "recording" should read --recorded--.

UNITED STATES PATENT AND TRADEMARK OFFICE

CERTIFICATE OF CORRECTION

PATENT NO. : 4,877,680

DATED : October 31, 1989

INVENTOR(S) : Mamoru Sakaki, et al.

It is certified that error appears in the above-identified patent and that said Letters Patent is hereby corrected as shown below:

COLUMN 6:

Line 38, "ink respectivity" should read --ink receptivity--.

Line 54, "beloqw" should read --below--.

COLUMN 7:

Line 8, "

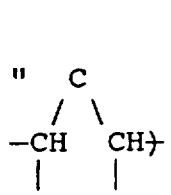

(III)"

should read

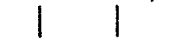

(III)--

COLUMN 10:

Line 11, "ligh transmissivity" should read --light transmissivity--.

UNITED STATES PATENT AND TRADEMARK OFFICE

CERTIFICATE OF CORRECTION

PATENT NO. : 4,877,680

DATED : October 31, 1989

INVENTOR(S) : Mamoru Sakaki, et al.

It is certified that error appears in the above-identified patent and that said Letters Patent is hereby corrected as shown below:

COLUMN 11:

Line 9, "surfactants etc." should read --surfactants, etc.--.

Signed and Sealed this

Thirtieth Day of July, 1991

*Attest:*

HARRY F. MANBECK, JR.

*Attesting Officer*

*Commissioner of Patents and Trademarks*